US010974539B2

(12) United States Patent
Kanari et al.

(10) Patent No.: US 10,974,539 B2
(45) Date of Patent: Apr. 13, 2021

(54) ROTARY FEEDING MECHANISM FOR ROD-SHAPED BODY

(71) Applicant: MICRO CO., LTD., Tokyo (JP)

(72) Inventors: Hiroyuki Kanari, Tokyo (JP); Tomohiro Hosoya, Tokyo (JP)

(73) Assignee: Micro Co., Ltd.

( * ) Notice: Subject to any disclaimer, the term of this patent is extended or adjusted under 35 U.S.C. 154(b) by 108 days.

(21) Appl. No.: 16/416,542

(22) Filed: May 20, 2019

(65) Prior Publication Data

US 2019/0358993 A1 Nov. 28, 2019

(30) Foreign Application Priority Data

May 24, 2018 (JP) ..... JP2018-99827

(51) Int. Cl.

| | |
|---|---|
| ***B43K 24/00*** | (2006.01) |
| ***B43K 21/08*** | (2006.01) |
| ***A45D 40/06*** | (2006.01) |
| ***A45D 40/04*** | (2006.01) |
| ***A45D 40/20*** | (2006.01) |

(52) U.S. Cl.

CPC ..... *B43K 24/00* (2013.01); *A45D 40/06* (2013.01); *A45D 40/04* (2013.01); *A45D 40/205* (2013.01); *A45D 2040/208* (2013.01); *B43K 21/08* (2013.01); *B43K 21/085* (2013.01)

(58) Field of Classification Search

CPC ..... B43K 24/00; B43K 24/06; B43K 21/02; B43K 21/027; B43K 21/06; B43K 21/08; B43K 21/085; A45D 40/06; A45D 40/20; A45D 40/205; A45D 40/02; A45D 2040/205; A45D 2040/00; A45D 2040/20; A45D 2040/208; A45D 40/04

USPC ..... 401/75–78

See application file for complete search history.

(56) References Cited

U.S. PATENT DOCUMENTS

| | | | | |
|---|---|---|---|---|
| 7,938,591 | B2 * | 5/2011 | Kokai | A45D 40/04 401/75 |
| 8,376,641 | B2 * | 2/2013 | Fraillon | A45D 40/20 401/29 |

FOREIGN PATENT DOCUMENTS

| | | |
|---|---|---|
| JP | 60067726 | 5/1985 |
| JP | 1131586 | 9/1989 |

* cited by examiner

*Primary Examiner* — David J Walczak
(74) *Attorney, Agent, or Firm* — Adams & Wilks

(57) ABSTRACT

A rotary feeding mechanism for axially feeding a rod-shaped body from a main body by rotating a tapered tip has a simple structure and can be produced economically. The main body is provided with plural open windows are arranged at a predetermined thread pitch along an axial direction of the main body. The tapered tip is installed rotatably on the main body, and a guide pipe extending toward the inside of the main body is fixed to the tapered tip. A holder for holding the rod-shaped body is housed in the main body, and the holder and the guide pipe are connected non-rotatably and movably in the axial direction. The outer periphery of the holder has an external thread which engages with the windows so that when the tapered tip is rotated, the holder moves in the axial direction while rotating via the guide pipe, and the rod-shaped body can be projected from or retracted into the main body.

20 Claims, 6 Drawing Sheets

ROTARY FEEDING MECHANISM FOR ROD-SHAPED BODY

FIELD OF THE INVENTION

The present invention relates generally to a rotary feeding mechanism for axially feeding a rod-shaped body and more particularly to a feeding mechanism useable in writing instruments, cosmetic instruments and other devices for projecting or retracting a rod-shaped body from or into a main body by a rotation operation.

BACKGROUND INFORMATION

Feeding mechanisms using a rotation operation have been known as a mechanism for feeding a rod-shaped body such as pencil leads, erasers, ink refills, crayons, etc. in writing instruments and lipsticks, eyeliners, etc. in cosmetic instruments.

As a simple and easy rotary feeding mechanism, for example, a cosmetic instrument described in UM-A-Sho 60-67726 has a helical spring (coil spring) disposed in a main body in which a holder for holding a rod-shaped body is hooked over the helical spring. The holder is moved forward or backward by rotation of the helical spring thereby projecting or retracting the rod-shaped body. Since the mechanism uses a helical spring, it is complicated to manufacture and assemble and not economical. In addition, in this mechanism, the whole helical spring is rotatably moved by actuating an end side of the helical spring that extends lengthwise in the axial direction of the rod-shaped body. As a result, variations are likely to arise in the pitch of the spring and may sometimes cause unstable feeding of the rod-shaped body. Further, the rod-shaped body is held by the holder, and if the holding power of the holder is too large, when the rod-shaped body is used up and needs to be replaced with a new one, the rod-shaped body residue remaining in the holder is difficult to detach, resulting in troublesome replacement.

UM-A-Hei 1-131586 describes a mechanism using no helical spring. In the mechanism described in this publication, helical grooves are formed on an inner face of a main body and a lateral projection of a holder is engaged with the helical grooves. In this structure, when the holder is rotated by a holder guide installed at the rear end of the main body, the holder is moved in an axial direction by which a rod-shaped body is fed. This structure presents a simplified mechanism. However, for the formation of helical grooves on the inner face of the main body, at the time of plastic molding of the main body, the molding is carried out by use of a motor drive die using a core pin formed with a thread on its outer periphery, resulting in high costs and complicated production.

SUMMARY OF THE INVENTION

It is an object of the present invention to provide a rotary feeding mechanism in which rod-shaped bodies such as used in writing instruments or cosmetic instruments can be projected from or retracted into a main body by a rotation operation, without employing a conventionally used helical spring for forming a helical groove on the inner face of the main body.

It is another object of the present invention to provide the above-mentioned rotary feeding mechanism in which replacement of the rod-shaped bodies can be made easily.

The present invention relates to a rotary feeding mechanism for axially feeding a rod-shaped body, which comprises a main body having plural windows arranged at a predetermined pitch along an axial direction of a tubular wall portion of the main body. A rotation member is rotatably installed at an open end of the main body, and a guide pipe is fixed to the rotation member. A holder is provided for holding the rod-shaped body, and the holder is connected to the guide pipe non-rotatably and movably in the axial direction. An outer periphery of the holder has an external thread threadedly engaged with the windows.

Further, at an inner face of the tubular wall portion on which the windows open are plane sections extending in the axial direction and formed facing each other. In one embodiment, the rotation member is a tapered tip provided at a front portion of the main body. The guide pipe has an open groove extending in the axial direction, and the holder has a through-hole through which the guide pipe passes and an engagement projection slidably engaging with the open groove of the guide pipe. The holder has a holding pipe for holding the rod-shaped body, and the tapered tip has an expanding section on which a front end of the holding pipe abuts. The holding pipe and the expanding section have inclined faces that engage one another to expand the front end of the holding pipe when the holder abuts on the tapered tip.

In the present invention, as mentioned above, plural windows open on a wall portion of a tubular main body with a predetermined pitch along an axial direction, and an outer periphery of the holder housed in the main body has an external thread threadedly engaged with the windows. A rotation member is rotatably installed at an open end of the main body, a guide pipe is fixed to the rotation member, and the holder is connected to the guide pipe non-rotatably and movably in an axial direction. Accordingly, when the rotation member is rotated, the holder moves in an axial direction while rotating, and the rod-shaped body held by the holder can be projected from or retracted into the rotation member.

Further, when a holding pipe for holding the rod-shaped body is disposed in the holder, and the tapered tip is provided with an expanding section on which the front end of the holding pipe abuts, the holding pipe abuts on the tapered tip when the holder moves forward to its frontmost position. In the structure wherein the expanding section of the holding pipe is provided with an inclined face which expands the front end of the holding pipe, when the rod-shaped body is used up and needs replacement, the front end of the holding pipe of the holder is expanded to release the rod-shaped body and therefore the remaining remnants of the rod-shaped body can be easily removed and replaced with a new rod-shaped body.

The windows of the main body and the external thread of the holder are formed in such a structure that the windows open at the outer face side of the main body and the external thread is disposed at the outer periphery of the holder, and therefore these can be easily formed by use of a mold for conventional plastic molding, which is economical. Further, at the inner face of the wall section of the main body at which the windows open, the plane sections extending in the axial direction are formed to face each other. Therefore, the open internal edges of the windows are positioned toward the center of the main body away from the inner side face of the wall section of the main body, and the external thread disposed at the outer face of the holder can securely and threadedly engage with the open internal edges of the windows, and therefore rotation of the guide pipe can bring about appropriate movement of the holder in the axial direction.

DETAILED DESCRIPTION OF THE PREFERRED EMBODIMENTS

The rotary feeding mechanism of the present invention may be applied to the feeding of an appropriate rod-shaped body in various devices, for example, in writing instruments such as mechanical pencils, ball point pens and liquid pens, and in cosmetic instruments such as lipsticks and eyeliners.

Figure 1:
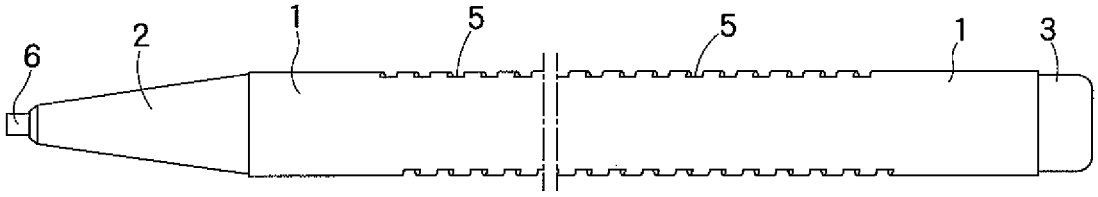
FIG. 1 is a partial front view of one example of a rotary feeding mechanism according to the present invention.
Figure 2:
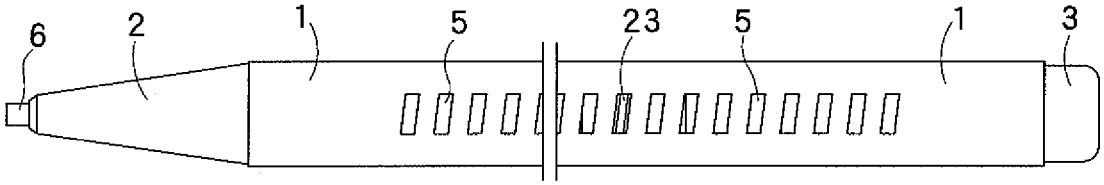
FIG. 2 is a partial plan view thereof.
Figure 3:
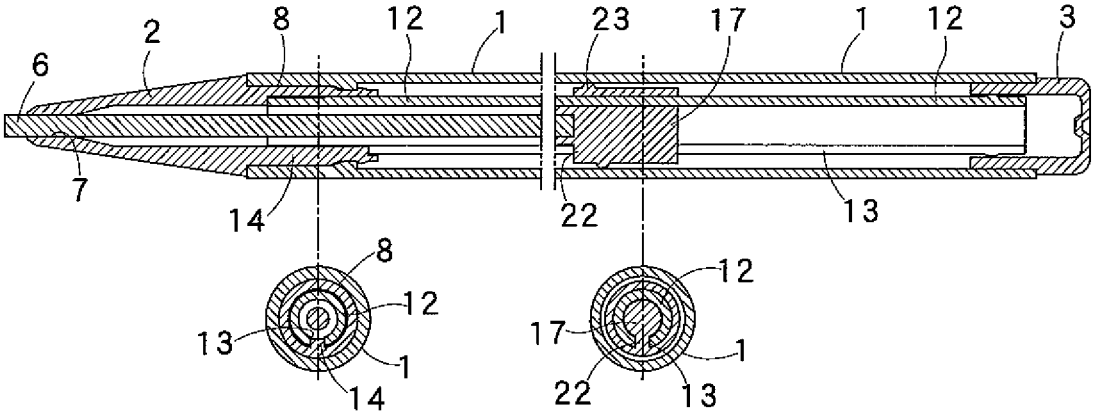
FIG. 3 is a cross-sectional view thereof of a part having no windows.
Figure 4:
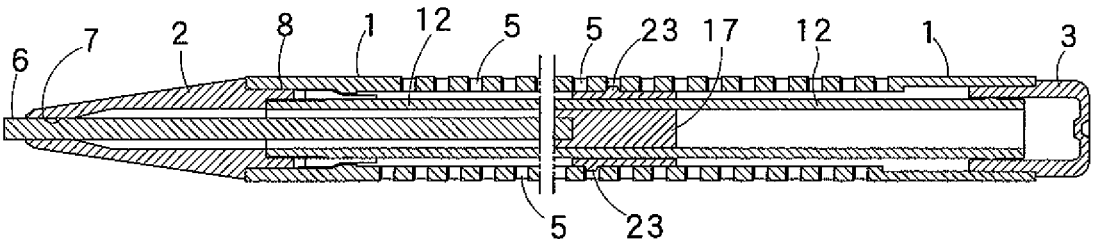
FIG. 4 is a cross-sectional view thereof of a part having windows.
Figure 5:
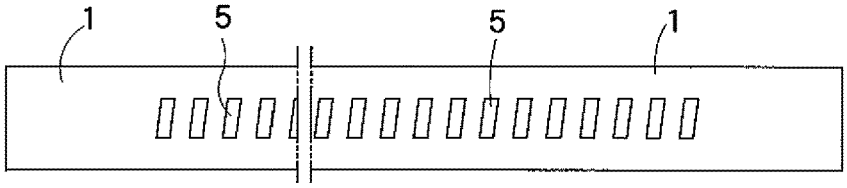
FIG. 5 is a plan view of a main body.
Figure 6:
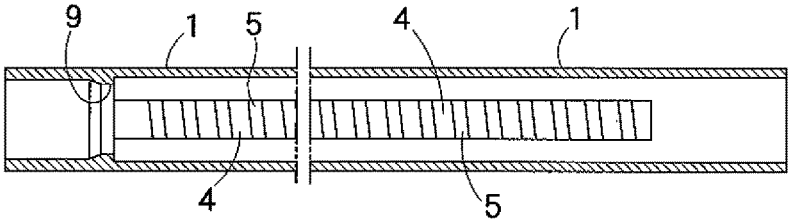
FIG. 6 is a cross-sectional view of the main body.
Figure 7:
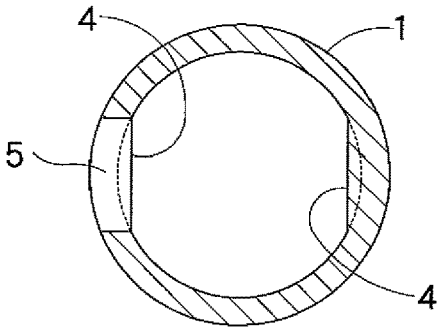
FIG. 7 is an enlarged cross-sectional view of the main body taken in a plane having a window.

FIG. 1 shows an example of a rotary feeding mechanism in accordance with the principles of the present invention for feeding a pencil lead of a writing instrument. In FIGS. 1 and 2, a main body of a writing instrument 1 has a tapered tip (front end member) 2 at a front open end, and a rear stopper (rear end member) 3 at a rear open end. The main body 1 is formed in a tubular shape having a circular cross-section. As shown in FIGS. 6-7, the main body 1 has opposed plane sections 4 which face each other along the axial direction at the inner face of the wall section of the main body. Windows 5 in the form of through openings are formed along the wall section and open at the plane sections 4. The windows 5 are slantwise openings in the general shape of a parallelogram and are spaced apart from one another at regular intervals and are arranged with a predetermined pitch along the axial direction.

Figure 8:
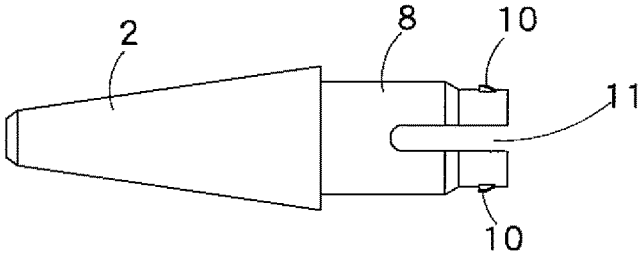
FIG. 8 is a plan view of a tapered tip.
Figure 9:
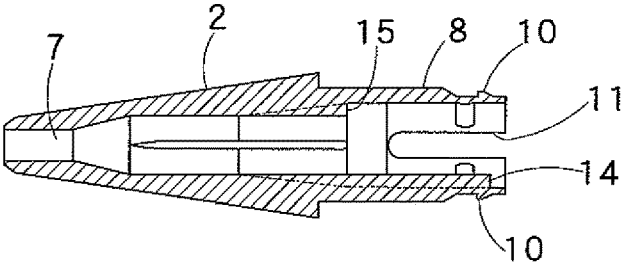
FIG. 9 is a cross-sectional view of the tapered tip.

The tapered tip 2 disposed at the front part of the main body 1 is connected rotatably to the main body 1 so that the tapered tip may act as a rotating member. As shown in FIGS. 8-9, the tapered tip 2 has a through-hole 7 through which a lead (rod-shaped body) 6 passes, and a tubular section 8 at its rear portion. The tapered tip 2 has an outer diameter appropriately sized so that it may be inserted into the front portion of the main body 1, and engaging sections 10 at its outer periphery so that the tapered tip 2 may be rotatably engaged with an inwardly protruding engagement section 9 (see FIG. 6) formed at the inner face of the main body 1. The tubular section 8 has a slit 11 as shown in FIG. 8 so that the engagement sections 9, 10 may be easily engaged. The inside of the tapered tip 2 has a rising (sloped) section 14 extending in the axial direction and a rib 15 on which the front end of a guide pipe 12 abuts (see FIG. 9), and an open groove 13 of the guide pipe 12 (see FIGS. 11 and 12) engages with the rising section 14 of the tapered tip 2 so that the guide pipe and the tapered tip rotate as a unit.

Figure 10:
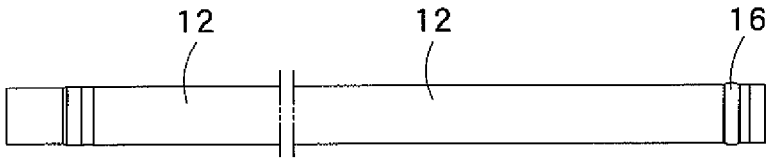
FIG. 10 is a plan view of a guide pipe.
Figure 11:
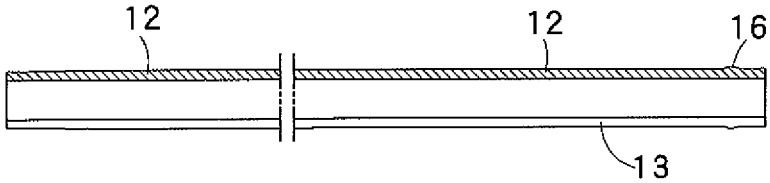
FIG. 11 is a cross-sectional view of the guide pipe.
Figure 12:
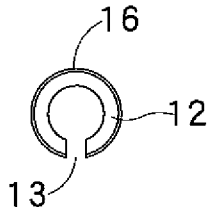
FIG. 12 is an end view of the guide pipe.

As shown in FIGS. 10-12, the guide pipe 12 is a tubular body having an outer diameter configured to be inserted into the main body 1, and the guide pipe has an open groove 13 on its one side which opens along the axial direction, namely it is formed in a substantially C-letter shape. As mentioned above, the guide pipe 12 is fixed to the tapered tip 2 by engaging the open groove 13 with the rising section 14 of the tapered tip 2, and when the tapered tip 2 is turned, the guide pipe 12 is turned together therewith. A projection section 16 is formed on the rear periphery of the guide pipe 12 and engages the rear stopper 3. In this example, the guide pipe side is provided with an annular projection and the rear stopper side is provided with a complementary receiving hole with which the projection engages for connection between the rear stopper and guide pipe, or these parts may be integrally formed (not shown).

Figure 13:
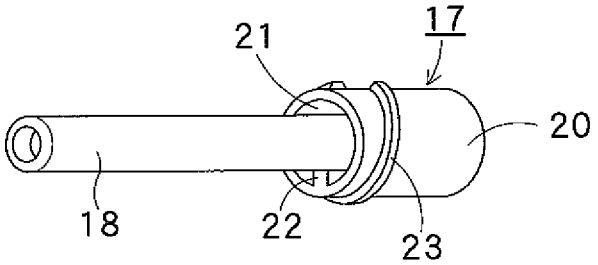
FIG. 13 is a perspective view of a holder.
Figure 14:
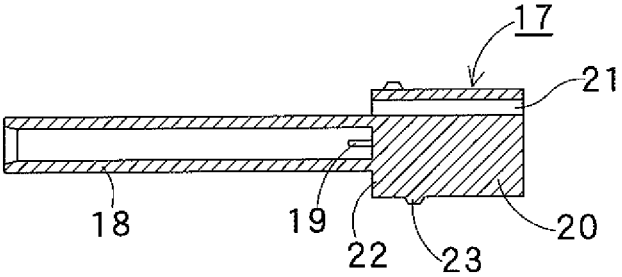
FIG. 14 is a cross-sectional view of the holder.

The guide pipe 12 extends slidably through the holder 17. As shown in FIGS. 13 and 14, the holder 17 has at its front portion a holding pipe 18 which is inserted into the guide pipe 12 and holds the lead 6. On the inner face of the holding pipe 18, is formed a small projection 19 to which the rear end of the lead 6 is pressed to prevent detachment of the lead 6. The rear portion of the holder 17 is formed in a tubular part 20 having a diameter larger than that of the guide pipe 12, and the tubular part 20 has an annular through hole 21 through which the guide pipe 12 passes and an engagement projection 22 which slidably engages with the open groove 13 of the guide pipe 12. On the outer periphery of the tubular part 20, is formed an external thread 23 that threadedly engages with the windows 5 of the main body 1. The external thread 23 is formed on the outer periphery of the tubular part 20, extending substantially completely around the outer periphery.

Figure 15:
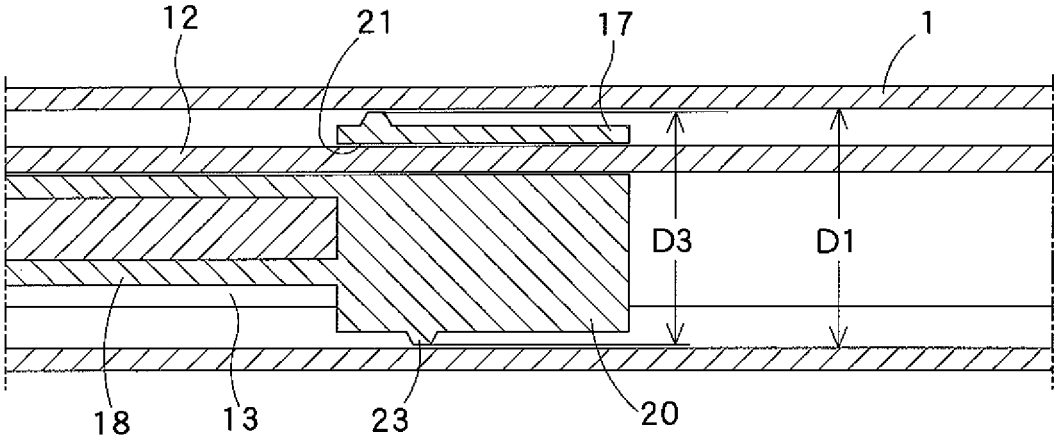
FIG. 15 is an explanatory sectional view showing the relationship of the main body, the holder and the guide pipe.
Figure 16:
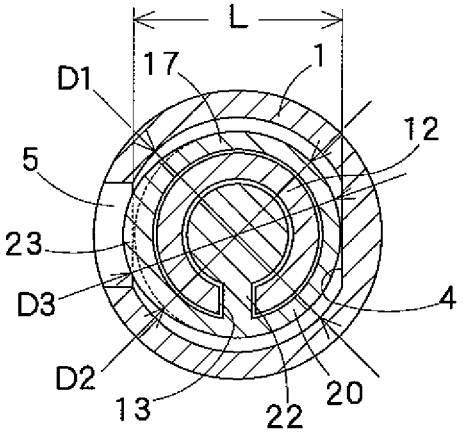
FIG. 16 is an explanatory sectional view showing the relationship of a window of the main body, the holder and the guide pipe.
Figure 17:
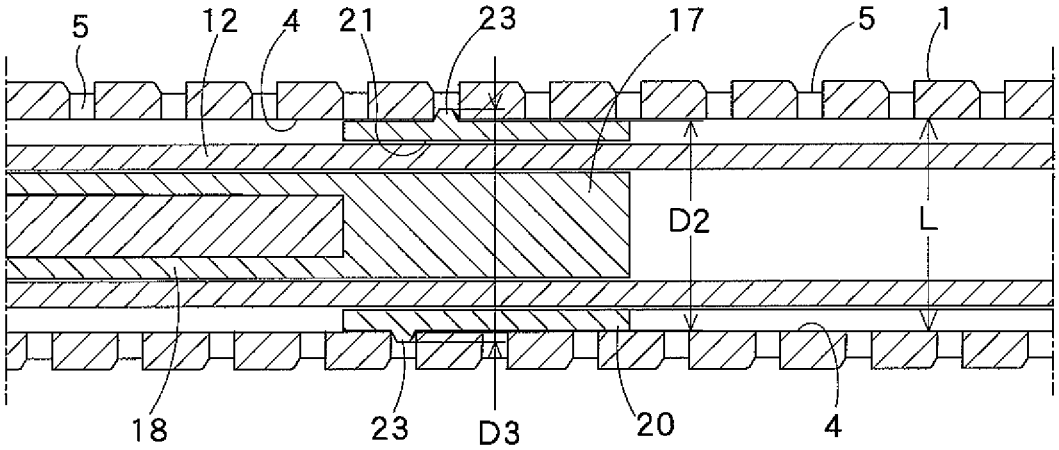
FIG. 17 is an explanatory sectional view showing the relationship of a plane section of the main body and the holder.

Referring to FIGS. 15-17, the relationship of the inner diameter D1 of the main body 1, the outer diameter D2 of the tubular part 20 of the holder 17, the outer diameter D3 of the thread 23 and the distance L between the plane sections 4 facing each other will be explained below. The inner diameter D1 of the main body 1 is slightly larger than the outer diameter D3 of the thread 23. The distance L between the plane sections 4 facing each other is narrower than the outer diameter D3 of the thread 23. Also, the windows 5 lie along an imaginary helical locus that has the same pitch as that of the thread 23. Accordingly, as shown in FIGS. 16 and 17, when the external thread 23 faces or confronts the windows 5 of the main body 1, the external thread is hooked over the open internal edge of the windows 5. In this example, the thread 23 is configured to simultaneously engage two of the windows 5, one on each of the two facing plane sections 4, so that turning of the holder 17 effects axial movement thereof by the interaction of the turning thread slidingly engaged with the stationary windows. By using this structure, when the holder 17 turns via the guide pipe 12, the holder 17 moves in the axial direction of the main body 1 by the action of the thread and the windows.

By the above structure, the holder 17 is connected to the guide pipe 12 non-rotatably and movably in the axial direction. Accordingly, when the tapered tip 2 turns, the holder 17 turns via the guide pipe 12, whereby the holder 17 moves in the axial direction of the main body 1 and projects the lead 6 from the front end of the tapered tip 2. When the tapered tip turns in a reverse direction, the lead 6 is retracted from the front end of the tapered tip 2 into the main body. In this example, the rear stopper (rear member) 3 is fitted to the rear end of the guide pipe 12 and turns together with the guide pipe 12, and therefore the lead may be projected or retracted by using the rear stopper 3 as a rotation member instead of the tapered tip 2.

In the above feeding mechanism, the rod-shaped body 6 is projected from and retracted into one side of the main body 1, but the rod-shaped body may be disposed within the main body so that the rod-shaped body may be projected from and retracted into both sides of the main body. Further, the present invention may be applied to a feeding mechanism of a writing instrument for feeding an eraser as a rod-shaped body from the rear side in addition to feeding the lead 6 as a rod-shaped body from the front side.

Figure 18:
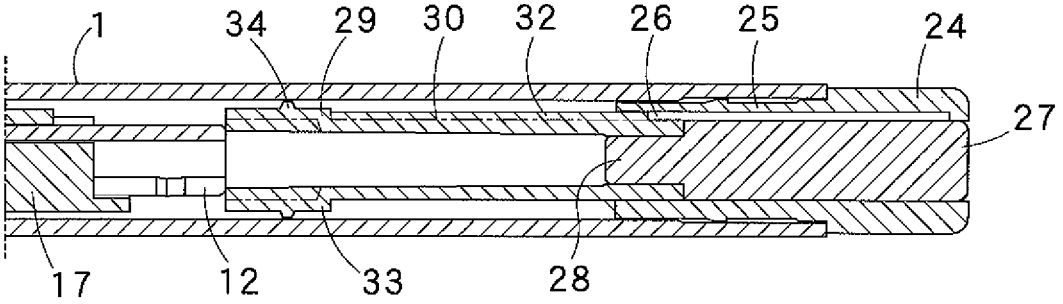
FIG. 18 is a partial cross-sectional view showing another example of a rotary feeding mechanism according to the present invention.
Figure 19:
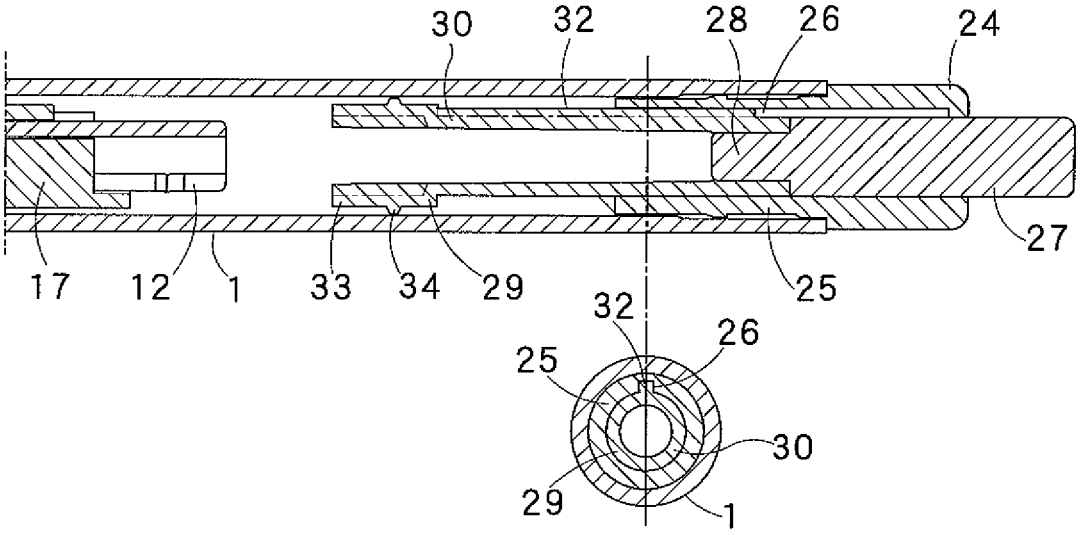
FIG. 19 is a partial cross-sectional view of the example shown in FIG. 18 and shows a condition where an eraser is fed.

This example is illustrated in FIG. 18 and FIG. 19. In this example, on the wall portion of the main body 1, plural windows 5 in the form of slanted openings of parallelogram shape are provided with a predetermined thread pitch at regular intervals and plane sections 4 which face each other are located inwardly from the windows 5. Since the structure is substantially the same as the above-mentioned example, the cross-sectional views of FIG. 18 and FIG. 19 are taken at the portion having no window and the windows are omitted from these figures.

As the rotation member, a rear stopper (rear member) 24 is rotatably attached to the open end at the rear portion of the main body 1, and at the forward part of the rear stopper 24, a guide pipe 25 is integrally formed. On the inner face of the guide pipe 25, an open groove 26 extending in the axial direction is formed. An eraser 27 is inserted from the opening formed at the rear stopper 24 and a small diameter part 28 formed at the front end of the eraser is held by a holding pipe 30 of a holder 29.

On the inner face of the holding pipe 30, small projections may preferably be provided to prevent detachment of the eraser 27. On the outer periphery of the holding pipe 30, an engagement projection 32 is disposed to slidably engage with the open groove 26. On the outer periphery of a tubular part 33 having a diameter larger than that of the holding pipe 30, an external thread 34 is formed to threadedly engage with the windows 5.

The relationships of the inner diameter of the main body 1, the outer diameter of the tubular part 33 of the holder 29, the outer diameter of the thread 34 and the distance between the plane sections 4 facing each other are the same as the above example. By this structure, the holder 29 is connected to the guide pipe non-rotatably and movably in the axial direction of the guide pipe 25. Since the external thread 34 is threadedly engaged with the open internal edge of the windows 5, when the rear stopper 24 turns, the holder 29 turns via the guide pipe 25 and moves in the axial direction. The eraser 27 is thereby projected rearwardly from the rear stopper 24 or retracted into the rear stopper 24.

In the examples shown in FIG. 1 to FIG. 17, the rod-shaped body 6 is held by the holding pipe 18 of the holder 17 and compressed for the purpose of preventing detachment by the small projection 19 (see FIG. 14) disposed at the deepest part of the holding pipe 18. At the time of replacing the rod-shaped body with a new one, if the rod-shaped body is made of a hard material such as a lead of a pencil, the remaining portion of the rod-shaped body can be easily detached by drawing it out of the holding pipe.

If the rod-shaped body is made of a soft material and drawn out of the holding pipe by force, remnants of the rod-shaped body may unwantedly remain in the holding pipe. To prevent such a situation from occurring, a structure of the following example may be used.

Figure 20:
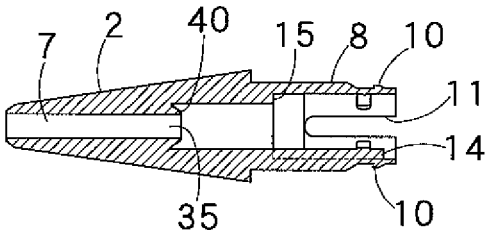
FIG. 20 is a cross-sectional view of another example of a tapered tip.
Figure 21:
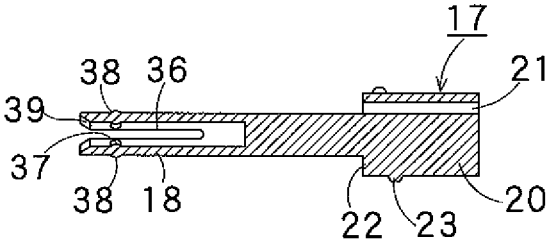
FIG. 21 is a cross-sectional view of a holder useable with the tapered tip shown in FIG. 20.

As shown in FIG. 20, within the tapered tip 2, an expanding section 35 is provided so that the front end of the holding pipe 18 abuts on the expanding section when the holder 17 moves to its frontmost position. The holding pipe 18 is provided with a slit 36 by which the front end of the holding pipe can be expanded in a radial direction as shown in FIG. 21. At the inner face side of the holding pipe 18, a small projection 37 for holding the rod-shaped body is formed corresponding to the slit, and at the outer face side of the holding pipe 18, an expansion-preventing projection 38 is formed which abuts on the inner face of the guide pipe 12 to stop or limit the expansion of the holding pipe 18 when the rod-shaped body is being used. The expansion-preventing projection 38 is located at such position that when the holder 17 moves forward to its frontmost position, the front part of the holding pipe 18 comes out of the front end of the guide pipe. On the front inner face of the holding pipe 18 and the outer face of the expanding section 35, inclined faces 39, 40 are provided to expand the holding pipe 18 when the holder 17 abuts on the tapered tip 2.

Figure 22:
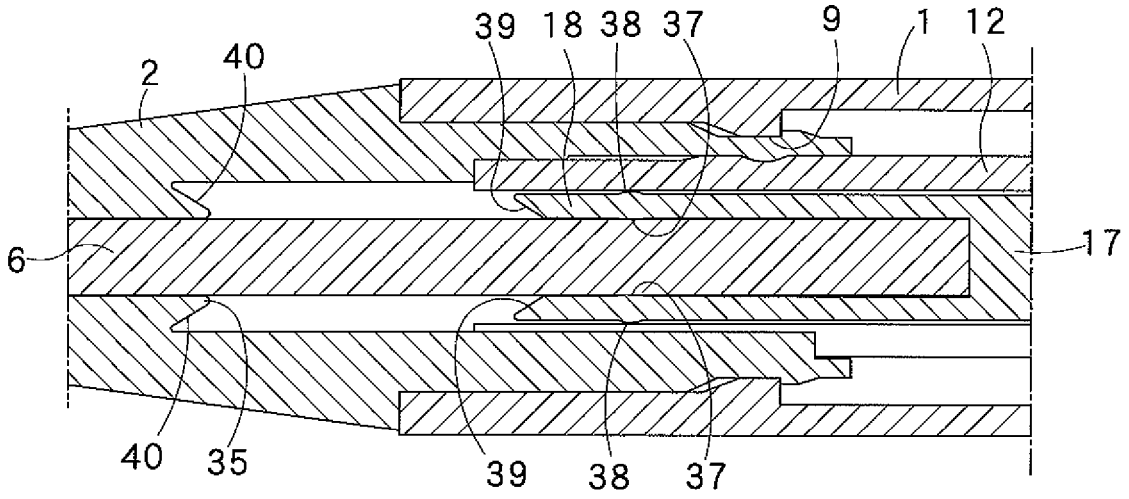
FIG. 22 is an enlarged explanatory view showing a condition where a rod-like body is fed.
Figure 23:
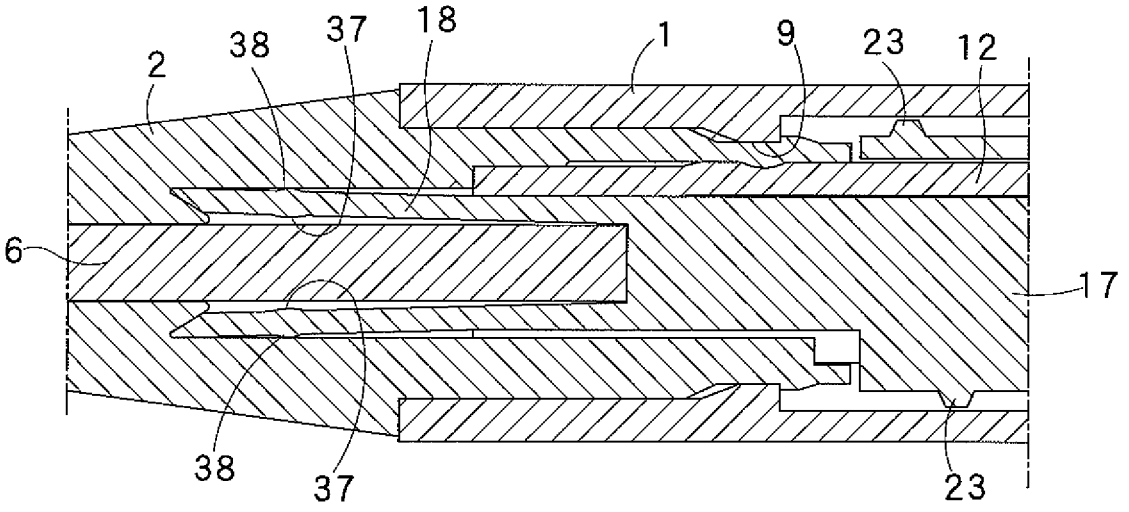
FIG. 23 is an enlarged explanatory view showing a condition where a holder abuts on a tapered tip in the example shown in FIG. 22.

By the above structure, the rod-shaped body 6 is held by the small projection 37 of the holding pipe 18 for preventing detachment, and as shown in FIG. 22, may be used substantially in the same way as the above examples. When the holder 17 moves forward to its frontmost position, as shown in FIG. 23, the holding pipe 18 of the holder 17 projects forward beyond the guide pipe 12, the front end thereof abuts on the expanding section 35 of the tapered tip 2, the front ends of the holding pipe 18 are expanded by the action of the inclined faces 39,40, and the small projection 37 departs and disengages from the outer periphery of the rod-shaped body 6 whereby the rod-shaped body is released. At this moment, the expansion-preventing projection 38 slips out of the guide pipe 12 and faces the hole of the taper of which the inner diameter is larger than the inner diameter of the guide pipe 12, and therefore it will not prevent the expansion of the holding pipe 18. As mentioned above, since the outer periphery of the rod-shaped body is not pressed by the holding pipe, the remainder of the rod-shaped body can be easily drawn out of the holding pipe and replaced with a new rod-shaped body.

In the above examples, an open groove is disposed at the guide pipe side and the engagement projection is disposed at the holder side. However, the engagement projection may be disposed at the guide pipe side and the open groove may be disposed at the holder side. Also, instead of a writing instrument, various types of rod-shaped bodies may be rotatably fed from the main body of other devices using the rotary feeding mechanism of the present invention.

It will be appreciated by those skilled in the art that obvious changes and modifications can be made to the embodiments described in the foregoing description without departing from the broad inventive concept thereof. It is understood, therefore, that this disclosure is not limited to the particular examples and embodiments disclosed, but is intended to cover all obvious changes and modifications thereof which are within the scope and spirit of the disclosure as defined by the appended claims.

What is claimed is:

1. A rotary feeding mechanism for axially feeding a rod-shaped body, comprising: a main body having plural open windows arranged at a predetermined pitch along an axial direction of a tubular wall portion of the main body; a rotation member rotatably installed at an open end of the main body; a guide pipe fixed to the rotation member; and a holder for holding the rod-shaped body, wherein the holder is connected to the guide pipe non-rotatably and movably in the axial direction, and an outer periphery of the holder has an external thread threadedly engaged with the windows.

2. The rotary feeding mechanism for axially feeding a rod-shaped body according to claim 1; wherein an inner face of the tubular wall portion has plane sections extending in the axial direction and facing each other; the windows are provided in the plane sections; an inner diameter D1 of the main body is larger than an outer diameter D3 of the external thread; and a distance L between the plane sections facing each other is narrower than the outer diameter D3 of the external thread.

3. The rotary feeding mechanism for axially feeding a rod-shaped boy according to claim 1; wherein the rotation member comprises a tapered tip provided at a front portion of the main body; the guide pipe has an open groove extending in the axial direction; the holder comprises a tubular section having the external thread thereon and a holding pipe for holding the rod-shaped body; the tubular section has a through-hole through which the guide pipe passes and an engagement projection slidably engaging with the open groove of the guide pipe; and the holding pipe is inserted into the guide pipe.

4. The rotary feeding mechanism for axially feeding a rod-shaped body according to claim 3; wherein the tapered tip has an expanding section on which a front end of the holding pipe abuts; and each of the holding pipe and the expanding section has an inclined face configured to expand a front portion of the holding pipe when the holder abuts on the tapered tip.

5. The rotary feeding mechanism for axially feeding a rod shaped body according to claim 4, wherein the holding pipe has a slit; at an inner face of the holding pipe is provided a small projection for holding the rod-shaped body; and at an outer face of the holding pipe is provided an expansion-preventing projection to limit expansion of the holding pipe.

6. The rotary feeding mechanism for axially feeding a rod-shaped body according to claim 1; wherein the rotation member comprises a rear stopper disposed at a rear portion of the main body; the guide pipe has an open groove on its inner face and is fixed to the rear stopper; and a holding pipe connected to the holder for holding the rod-shaped body, the holding pipe having an engagement projection engageable with the open groove of the guide pipe.

7. A rotary feeding mechanism for axially feeding a rod-shaped body, comprising: a main body having a tubular wall portion, the tubular wall portion having plural openings extending therethrough and arranged at a predetermined pitch along an axial direction of the tubular wall portion; a rotation member rotatably installed at an open end of the main body; a guide pipe disposed inside the main body and fixed to the rotation member; and a holder configured to hold the rod-shaped body for feeding in the axial direction inside the guide pipe, the holder being connected to the guide pipe to rotate therewith and to slide therealong in the axial direction, the holder having on an outer periphery thereof an external thread threadedly engaged with the openings in the main body; whereby rotation of the rotation member rotates the guide pipe and the holder as a unit accompanied by feeding of the rod-shaped body in the axial direction.

8. The rotary feed mechanism according to claim 7; wherein the external thread has a pitch the same as the predetermined pitch of the openings.

9. The rotary feed mechanism according to claim 7; wherein an inner face of the tubular wall portion has two circumferentially spaced plane sections extending in the axial direction, and the openings are provided at and extend through the plane sections.

10. The rotary feed mechanism according to claim 9; wherein the two plane sections are directly opposite and face one another.

11. The rotary feed mechanism according to claim 10; wherein an inner diameter D1 of the main body is larger than an outer diameter D3 of the external thread; and a distance L between the plane sections facing each other is narrower than the outer diameter D3 of the external thread.

12. The rotary feeding mechanism according to claim 7; wherein the rotation member comprises a tapered tip provided at a front portion of the main body; the guide pipe has an open groove extending in the axial direction; the holder comprises a tubular section having the external thread thereon and a holding pipe for holding the rod-shaped body; the tubular section has a through-hole through which the guide pipe passes and an engagement projection slidably engaging with the open groove of the guide pipe; and the holding pipe is inserted into the guide pipe.

13. The rotary feeding mechanism according to claim 12; wherein the tapered tip has an expanding section on which a front end of the holding pipe abuts; and each of the holding pipe and the expanding section has an inclined face configured to expand a front portion of the holding pipe when the holder abuts on the tapered tip.

14. The rotary feeding mechanism according to claim 13; wherein the holding pipe has a slit; at an inner face of the holding pipe is provided a small projection for holding the rod-shaped body; and at an outer face of the holding pipe is provided an expansion-preventing projection to limit expansion of the holding pipe.

15. The rotary feeding mechanism for axially feeding a rod-shaped body according to claim 7; wherein the rotation member comprises a rear member disposed at a rear portion of the main body; the guide pipe has an open groove on its inner face and is fixed to the rear member; and a holding pipe connected to the holder for holding the rod-shaped body, the holding pipe having an engagement projection engageable with the open groove of the guide pipe.

16. The rotary feed mechanism according to claim 7; wherein the rotation member comprises a rear member rotatably installed at an open rear end of the main body.

17. The rotary feed mechanism according to claim 7; wherein the rotation member comprises a front member rotatably installed at an open front end of the main body.

18. The rotary feed mechanism according to claim 7; wherein the openings lie along a helical locus.

19. A writing instrument comprising the rotary feeding mechanism according to claim 7.

20. A cosmetic instrument comprising the rotary feeding mechanism according to claim 7.

* * * * *